US008445169B2

(12) United States Patent
Tsutsui

(10) Patent No.: US 8,445,169 B2
(45) Date of Patent: May 21, 2013

(54) TONER FOR HYBRID DEVELOPMENT, DEVELOPER FOR HYBRID DEVELOPMENT AND IMAGE-FORMING APPARATUS

(75) Inventor: Chikara Tsutsui, Nishinomiya (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 683 days.

(21) Appl. No.: 12/477,169

(22) Filed: Jun. 3, 2009

(65) Prior Publication Data

US 2009/0317736 A1 Dec. 24, 2009

(30) Foreign Application Priority Data

Jun. 19, 2008 (JP) ..... 2008-160675

(51) Int. Cl.
*G03G 9/00* (2006.01)

(52) U.S. Cl.
USPC ..... 430/108.1; 430/111.1

(58) Field of Classification Search
USPC ..... 430/108.1, 108.6, 108.7, 110.3, 111.1
See application file for complete search history.

(56) References Cited

U.S. PATENT DOCUMENTS

| | | | | |
|---|---|---|---|---|
| 6,137,977 | A * | 10/2000 | Okado et al. | 399/252 |
| 2007/0212122 | A1* | 9/2007 | Maeyama et al. | 399/267 |
| 2008/0112733 | A1 | 5/2008 | Hirayama et al. | |
| 2008/0124135 | A1 | 5/2008 | Uetake et al. | |

FOREIGN PATENT DOCUMENTS

| | | | |
|---|---|---|---|
| JP | 59-100471 | A | 6/1984 |
| JP | 5-265252 | A | 10/1993 |
| JP | 6-329947 | A | 11/1994 |
| JP | 9-015904 | A | 1/1997 |
| JP | 09-269614 | A | 10/1997 |
| JP | 11-015300 | | 1/1999 |
| JP | 11-024372 | | 1/1999 |
| JP | 2002-351142 | A | 12/2002 |
| JP | 2003-287959 | A | 10/2003 |
| JP | 2007-086548 | | 4/2007 |
| JP | 2007-163747 | | 6/2007 |
| JP | 2007-256361 | | 10/2007 |
| JP | 2008-090234 | | 4/2008 |
| JP | 2008-122561 | | 5/2008 |
| JP | 2008-129498 | | 6/2008 |

OTHER PUBLICATIONS

Notification of Reasons for Refusal issued in the corresponding Japanese Patent Application No. 2008-160675 dated Apr. 27, 2010, and an English Translation thereof.
Notification of Reason for Refusal issued in the corresponding Japanese Patent Application No. 2008-160675, dated Aug. 31, 2010 and an English language translation thereof.

* cited by examiner

*Primary Examiner* — Stewart Fraser
(74) *Attorney, Agent, or Firm* — Buchanan Ingersoll & Rooney PC

(57) ABSTRACT

A toner for hybrid development, comprising toner particles containing at least a binder resin and a colorant and being charged when made in friction-contact with a carrier; reverse polarity particles that are charged to polarity reversed to the charged polarity of the toner particles when made in friction-contact with the carrier, and have a number-average primary particle size in a range from 95 to 850 nm; and same polarity particles that are charged into the same polarity as the charged polarity of the toner particles when made in friction-contact with the carrier, and have a number-average primary particle size in a range from 80 to 800 nm and a shape factor in a range from 100 to 160; a developer for hybrid development containing the above toner and a carrier; and an image-forming apparatus provided with the developer for hybrid development.

11 Claims, 5 Drawing Sheets

TONER FOR HYBRID DEVELOPMENT, DEVELOPER FOR HYBRID DEVELOPMENT AND IMAGE-FORMING APPARATUS

This application is based on application No. 2008-160675 filed in Japan, the contents of which are hereby incorporated by reference.

TECHNICAL FIELD

The present invention relates to a toner, a developer and an image-forming apparatus that are suitably used for a hybrid developing system.

BACKGROUND ART

With respect to developing systems used for the image-forming apparatus of an electrophotographic system, a mono-component developing system using only toner as a main component of a developer and a two-component developing system using toner and carrier as main components of a developer have been known.

A developing device of the mono-component developing system is provided with a toner supporting member that supports toner thereon and transports the toner and a frictional charging member that is made in contact with the toner supporting face of the toner supporting member. Upon passing through the contact position with the frictional charging member, the toner, supported on the toner supporting member, is made friction-contact with the frictional charging member to be formed into a thin film, and also charged to a predetermined polarity. In this manner, since the mono-component developing device carries out a toner-charging process through the friction-contact with the frictional charging member, the resulting advantage is that the structure is simple, small and inexpensive. However, toner degradation tends to occur due to a high stress at the contact position with the frictional charging member, and the toner chargeability tends to be impaired in a comparatively early stage. Due to the contact pressure between the toner supporting member and the frictional charging member, the toner adheres to the two members to cause degradation in the capability of charging the toner, with the result that the service life of the developing device is shortened comparatively.

Since the developing device of the two-component developing system charges the toner and the carrier to predetermined polarities by making them in friction-contact with each other, the stress to be applied to the toner is smaller in comparison with that of the mono-component developing device. Since the surface area of the carrier is larger in comparison with that of the toner, the carrier is less vulnerable to contamination due to adhesion of the toner. However, since stains (spent), that is, adhesion of toner fine fragments to the surface of the carrier particle, tend to occur due to a long-term use, the toner-charging capability is consequently lowered to cause problems of fogging and toner scattering. An attempt may be made to increase the amount of the carrier to be housed in the developing device so as to prolong the service life of the two-component developing device; however, this causes a large size of the developing device.

In order to solve the above-mentioned problems relating to the two-component developing device, a developing system has been reported in which the carrier or the carrier and the toner are supplied on demand, while the developer whose charging capability has been lowered is collected (Japanese Patent-Application Laid-Open No. 59-100471). In accordance with this technique, the life of the developer can be prolonged without the necessity of a large-size developing device. However, another mechanism for collecting the discharged carrier is required. The consumption of the carrier increases, resulting in problems of costs and the environment. Furthermore, a predetermined amount of printing processes need to be carried out until the rate of undeteriorated carrier and deteriorated carrier has been stabilized.

Japanese Patent-Application Laid-Open No. 2003-287959 has proposed a hybrid developing system in which, from a developer containing a toner and a carrier, held on the outer circumferential face of a magnetic roller, only the toner is selectively supplied onto the outer circumferential face of a developing roller, and by using only the toner held on the outer circumferential face of this developing roller, an electrostatic latent image (electrostatic latent image portion) on a photosensitive member is developed. In such a developing system, reverse polarity particles that are charged to a polarity reversed to the charge polarity of the toner when made in friction-contact with the carrier are added to the developer so as to adhere to the carrier. Thus, the corresponding reverse polarity particles serve as charging sites for the carrier so that the toner charging capability of the carrier is ensured, and the carrier deterioration can be suppressed.

In the above-mentioned hybrid developing system, however, the toner holding time is comparatively long, with the result that, for example, when an image with a small image area ratio (white/black ratio), such as a character image, is continuously printed, the reverse polarity particles are progressively buried into the toner particle, failing to obtain a stable toner developing property for a long period. The resulting problem is that, upon executing endurance printing processes, the image density is lowered.

In an attempt to further externally add particles having the same polarity as that of the charge polarity of toner particles, since the corresponding same polarity particles are not allowed to effectively adhere to, and secured onto the toner particle, it is also not possible to obtain a stable toner developing property for a long period, and upon executing endurance printing processes, the image density is lowered.

SUMMARY OF INVENTION

An object of the present invention is to provide a toner for hybrid development, a developer and an image-forming apparatus that can execute toner development stably for a long period.

The present invention provides a toner for hybrid development in accordance with the present invention, comprising:

toner particles containing at least a binder resin and a colorant and being charged when made in friction-contact with a carrier;

reverse polarity particles that are charged into polarity reversed to the charged polarity of the toner particles when made in friction-contact with the carrier, and have a number-average primary particle size in a range from 95 to 850 nm; and same polarity particles that are charged into the same polarity as the charged polarity of the toner particles when made in friction-contact with the carrier, and have a number-average primary particle size in a range from 80 to 800 nm and a shape factor in a range from 100 to 160.

ADVANTAGEOUS EFFECTS OF INVENTION

In accordance with the present invention, by using specific external additive particles having the same polarity as that of the toner particles, reverse polarity particles are smoothly transported onto the surface of the carrier particle and allowed to effectively function as charging sites on the carrier surface. For this reason, it is possible to suppress a reduction in the toner-charging capability of the carrier for a long period, and consequently to carry out a toner charging process stably for a long period. The same polarity particles are allowed to effectively behave together with the toner particles so that the flowability of the toner particles on the developing roller is improved and consequently, the developing characteristic can be improved. As a result, the reduction in the image density can be suppressed even upon carrying out endurance printing processes. These effects can be obtained even when an image with a small image area ratio (white/black ratio), for example, such as a character image, is continuously printed.

DESCRIPTION OF EMBODIMENTS

Figure 1:
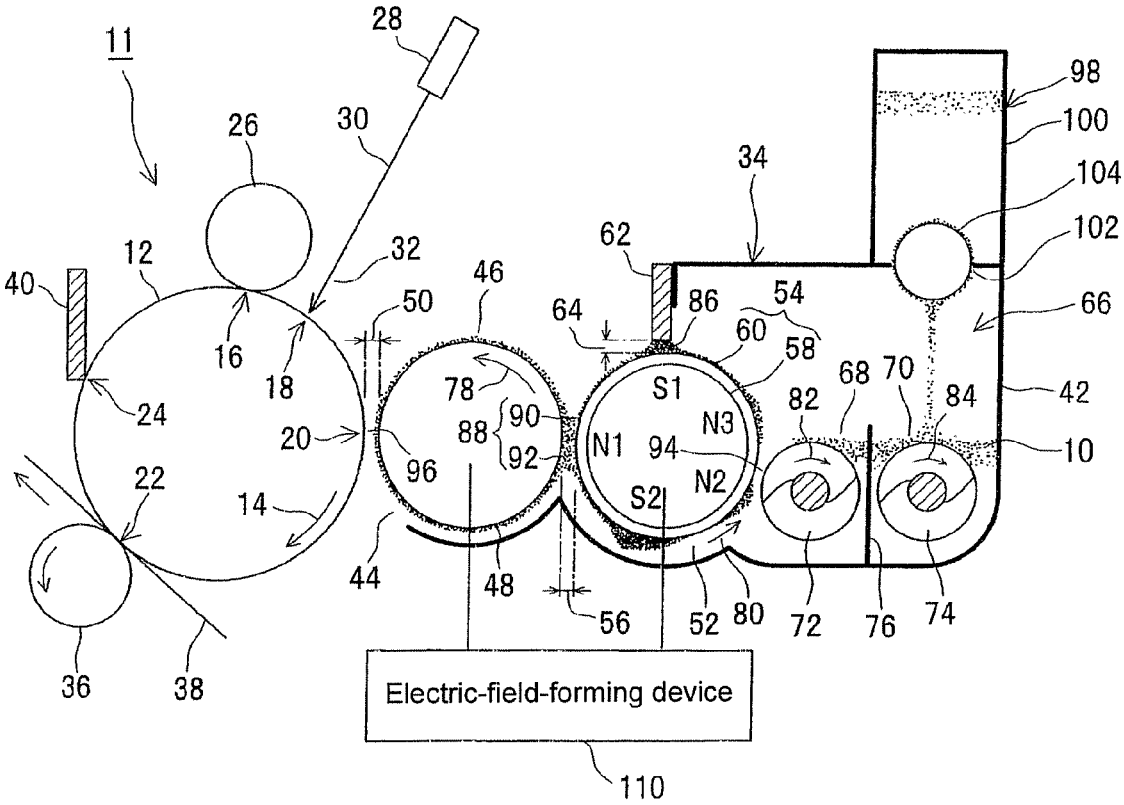
FIG. 1 is a view that shows a schematic structure of one example of an image-forming apparatus in accordance with the present invention and a cross section of a developing device in accordance with the present invention.

The present invention relates a toner for hybrid development in accordance with the present invention, comprising:

toner particles containing at least a binder resin and a colorant and being charged when made in friction-contact with a carrier;

reverse polarity particles that are charged into polarity reversed to the charged polarity of the toner particles when made in friction-contact with the carrier, and have a number-average primary particle size in a range from 95 to 850 nm; and same polarity particles that are charged into the same polarity as the charged polarity of the toner particles when made in friction-contact with the carrier, and have a number-average primary particle size in a range from 80 to 800 nm and a shape factor in a range from 100 to 160.

The present invention also relates to a developer for hybrid development containing the toner and a carrier and an image-forming apparatus provided with the developer for hybrid development.

Toner for Hybrid Development

A toner for hybrid development (hereinafter, referred to simply as "toner") relating to the present invention includes toner particles and external additives to be applied to each toner particle.

The toner particles include at least a binder resin and a colorant, and are charged to predetermined polarity when made in friction-contact with carrier. The toner particles may contain other additives such as a releasing agent and/or a charge-controlling agent.

Although not particularly limited, examples of binder resins to be contained in the toner particles include: styrene-based resins (homopolymer containing styrene or styrene substitute, or copolymer, for example, a styrene-acrylic copolymer), polyester resins, epoxy-based resins, vinyl chloride resins, phenolic resins, polyethylene resins, polypropylene resins, polyurethane resins, silicone resins, nitrogen-containing acrylic resins, or resins formed by desirably mixing these resins. The binder resin is preferably formed so that its softening temperature is set in a range of about 80 to 160° C., with its glass transition point being set in a range of about 40 to 75° C.

The binder resin used for toner particles is preferably determined by taking into consideration a charging polarity of toner particles upon developing. For example, for negatively chargeable toner particles, preferably, one of styrene-acrylic copolymers and polyesters may be used alone, or two of these may be mixed on demand and used. For positively chargeable toner particles, a styrene-acrylic copolymer may be preferably used.

The colorant may be used from known materials conventionally used as colorants in the field of toner. Specific examples of the colorant include: carbon black, aniline black, activated carbon, magnetite, Benzidine Yellow, Permanent Yellow, Naphthol Yellow, Phthalocyanine Blue, Fast Sky Blue, Ultramarine Blue, Rose Bengal and Lake Red. In general, the added amount of the colorant is preferably set in a range from 2 to 20 parts by weight relative to 100 parts by weight of a binder resin.

The releasing agent may be used from known materials conventionally used as releasing agents in the field of toner. Specific examples of the releasing agent include: polyethylene, polypropylene, carnauba wax, sazol wax, or a mixture formed by combining these on demand. The releasing agent is preferably used at a rate of 0.1 to 10 parts by weight relative to 100 parts by weight of a binder resin.

The charge-controlling agent may be made from known materials conventionally used as charge-controlling agents in the field of toner. Specific examples thereof used for the positively chargeable toner particles include: Nigrosine dyes, quaternary ammonium salt-based compounds, triphenylmethane-based compounds, imidazole-based compounds and polyamine resins, which serve as positive-charge-controlling agents. Specific examples of the charge-controlling agent used for the negatively chargeable toner include: metal-containing azo-based dyes of Cr, Co, Al and Fe, salicylic acid metal compounds, alkyl salicylic acid metal compounds, and calix arene-based compounds, which serve as negative-charge-controlling agents. The charge-controlling agent is preferably used at a rate of 0.1 to 10 parts by weight relative to 100 parts by weight of a binder resin.

Although not particularly limited, examples of the method for manufacturing toner particles include: a so-called pulverizing method, and wet methods, such as a suspension polymerization method, an emulsion polymerization association method and a solution suspension method. From the viewpoints of a sharp particle size distribution of toner particles, superior images and long service life of the developer, the toner particles made by the emulsion polymerization association method are preferably used. Although not particularly limited, the volume-average particle size of the toner particles is set to, for example, about 3 to 15 μm. The average particle size of the toner particles is represented by a value measured by a Coulter Multisizer III (made by Beckman Coulter, Inc.), with an aperture tube of 100 μm being used.

The following description will explain a method for manufacturing toner particles by the use of an emulsion polymerization association method. The manufacturing method for toner particles by the emulsion polymerization association method is a method in which toner particles are formed in an aqueous medium, and this method is disclosed in, for example, Japanese Patent-Application Laid-Open No. 2002-351142. Japanese Patent-Application Laid-Open No. 5-265252, Japanese Patent-Application Laid-Open No. 6-329947 and Japanese Patent-Application Laid-Open No. 9-15904 have disclosed a method in which resin particles are allowed to salt-out/fusion-adhere to one another in an aqueous medium so that a toner particle dispersion solution is produced. More specifically, after resin particles together with colorant particles, if necessary, have been dispersed in water by using an emulsifier, a coagulant is added thereto at a critical coagulation concentration or more so that this is salted out (coagulated) and the polymer thus formed is simultaneously headed and fused at a temperature more than a glass transition temperature; thus, fused particles are formed, with the particle size thereof being allowed to gradually grow, and at the time when the target particle size has been achieved, a large amount of water is added thereto so that the growth of the particle size is stopped, and the particle surface is smoothed, while being further heated and stirred, so as to control the shape to prepare a toner particle dispersion solution. Together with the coagulant, a solvent that is infinitely dissolved in water, such as alcohol, may be simultaneously added thereto. Although not particularly limited, examples of the aqueous medium include: water, methanol, ethanol, isopropanol, butanol, 2-methyl-2-butanol, acetone, methylethyl ketone, tetrahydrofran, and a mixture thereof. Upon producing the toner particles, selection can be properly made among these. Another organic solvent may be further added to the aqueous medium. Although not particularly limited, examples of the organic solvent include toluene, xylene, or a mixture thereof.

With respect to the external additive to be added to toner particles, at least, reverse polarity particles and same polarity particles are used.

The reverse polarity particles are those particles that are charged to a polarity reversed to the charge polarity of the toner particles relative to the carrier, when made in friction-contact with the carrier. The fact that the charge polarity relative to the carrier is different between the reverse polarity particles and the toner particles can be confirmed by measuring the charge quantity thereof relative to the carrier. For example, the carrier and reverse polarity particles are subjected to a predetermined mixing process, and the charge quantity of the reverse polarity particles is measured by using a blow-off method. The carrier and toner particles are also subjected to a predetermined mixing process, and the charge quantity of the toner particles is measured by using the blow-off method. As a result, when the charge quantity of the reverse polarity particles and the charge quantity of the toner particles have polarities mutually opposite in sign to each other, it is confirmed that the charge polarities of those particles relative to the carrier are different from each other.

The charge quantity in accordance with the blow-off method can be measured by using a charge quantity measuring device "Blow-off Type TB-200" (made by Toshiba Corporation).

In the case when, for example, toner particles that are charged to negative polarity upon frictional contact with the carrier are used, those particles that are charged to a positive polarity upon frictional contact with the carrier are used as the reverse polarity particles. Examples of those particles include inorganic particles, such as strontium titanate, barium titanate, magnesium titanate, calcium titanate and alumina, and resin particles formed by thermoplastic resins or thermosetting resins, such as acrylic resins, benzoguanamine resins, nylon resins, polyimide resins and polyamide resins. Those particles, formed by allowing the resin forming the reverse polarity particles to contain a positive-charge controlling agent that is charged to positive polarity when made in contact with the carrier, may also be used. Examples of the positive-charge controlling agent include Nigrosine dye and a quaternary ammonium salt. The reverse polarity particles may be formed by a nitrogen-containing polymer. Examples of the monomer material for forming the nitrogen-containing polymer include: 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole and vinyl imidazole. Examples of preferable combinations between the resin forming the carrier and the material forming the reverse polarity particles (positively chargeable) are shown below: The resin forming the carrier is defined as including a binder resin in the case of the binder-type carrier and a coat resin in the case of the coat-type carrier.

Carrier-Forming Resin • Reverse Polarity Particles (Positively Chargeable)

Acrylic resin—Strontium titanate
Silicone resin—Barium titanate
Melamine resin—Calcium zirconate
Benzoguanamine resin—Magnesium zirconate In the case when, for example, toner particles that are charged to positive polarity upon frictional contact with the carrier are used, those particles that are charged to negative polarity upon frictional contact with the carrier are used as the reverse polarity particles. Examples of those particles include inorganic particles, such as silica and titanium oxide, and resin particles formed by thermoplastic resins or thermosetting resins, such as fluorine resins, polyolefin resins, silicone resins and polyester resins. Those particles, formed by allowing the resin forming the reverse polarity particles to contain a negative-charge controlling agent that is charged to negative polarity when made in contact with the carrier, may also be used. As the negative-charge controlling agent, salicylic acid-based, or naphthol-based chromium complexes, aluminum complexes, iron complexes, or zinc complexes may be used. The reverse polarity particles may be made from a copolymer of a fluorine-containing acrylic monomer or a fluorine-containing methacrylic monomer. Examples of preferable combinations between the resin forming the carrier and the material forming the reverse polarity particles (negatively chargeable) are shown below:

Carrier Forming Resin—Reverse Polarity Particles (Negatively Chargeable)

Acrylic resin—Silica
Fluorine resin—Silica
Polyester—Aluminum oxide
Polyolefin—Polyacrylic fluoride beads In order to control the chargeability and hydrophobicity of the reverse polarity particles, the surface of the inorganic particles may be surface-treated by using a silane coupling agent, a titanium coupling agent, silicone oil and the like. In particular, in an attempt to impart the positive polarity chargeability to the inorganic particles, the surface treatment is preferably carried out by using an amino-group containing coupling agent. In an attempt to impart the negative polarity chargeability to the inorganic particles, the surface treatment is preferably carried out by using a fluorine-group containing coupling agent.

The number-average primary particle size of the reverse polarity particles is set in a range from 95 to 850 nm, preferably from 100 to 600 nm. When the particle size of the reverse polarity particles is too small, the reverse polarity particles are buried into toner particle, and even when transported to the carrier, they fail to effectively function, with the result that the toner chargeability is lowered and the image density is lowered upon carrying out endurance printing processes. In the case when the particle size of the reverse polarity particles is too large, since the reverse polarity particles are hardly allowed to adhere to the surface of the carrier effectively, the image density is lowered upon carrying out endurance printing processes.

In the present specification, the number-average primary particle size of the reverse polarity particles is represented by a value measured through operations in which a thin-film piece is formed by using a microtome and after having been observed under a transmission-type electron microscope, the resulting piece is measured by using an image analyzer Luzex AP (made by Nireco Corporation).

Although not particularly limited, the shape factor of the reverse polarity particles is normally set to 120 to 250, preferably to 140 to 240.

In the present specification, the shape factor is calculated by the following processes: By using a scanning electron microscope, 100 pieces of images of particles within a range of the average particle size of an external additive, enlarged to 30000 to 50000 times, are randomly sampled, and those images taken into an image analyzer (Luzex A: made by Nireco Corporation) by a scanner are analyzed, and calculated based upon the following equation:

$$\text{Shape factor}=(\text{Largest diameter of particle})^2/(\text{Projection area of particle})\times\pi/4\times100$$

From the viewpoint of long-term stability for toner charge, the content of the reverse polarity particles is preferably set to 0.1 to 4 parts by weight, more preferably to 0.5 to 3 parts by weight, relative to 100 parts by weight of toner particles. Two or more kinds of reverse polarity particles may be used in combination, and in this case, the total amount thereof can be set within the above-mentioned range.

The same polarity particles are those particles that are charged to the same polarity as the charge polarity of the toner particles relative to the carrier, when made in friction-contact with the carrier. The fact that the charge polarity relative to the carrier is the same between the same polarity particles and the toner particles can be confirmed by measuring the charge quantity thereof relative to the carrier. For example, the carrier and same polarity particles are subjected to a predetermined mixing process, and the charge quantity of the same polarity particles is measured by using a blow-off method. The carrier and toner particles are also subjected to a predetermined mixing process, and the charge quantity of the toner particles is measured by using the blow-off method. As a result, when the charge quantity of the same polarity particles and the charge quantity of the toner particles have mutually the same polarity in sign with each other, it is confirmed that the charge polarities of those particles relative to the carrier are the same with each other.

The charge polarity of the same polarity particles caused by frictional contact with the toner particles can be indirectly confirmed by measuring the charge quantity of the toner particles due to frictional contact with the carrier and the charge quantity of the same polarity particles due to frictional contact with the carrier. For example, the carrier and the toner particles are subjected to a predetermined mixing process, and the charge quantity of the toner particles is measured by the blow-off method. The carrier and the same polarity particles are also subjected to a predetermined mixing process, and the charge quantity of the same polarity particles is measured by using the blow-off method. At this time, with respect to the measuring samples, the content of the same polarity particles relative to the carrier is made equal to the content of the toner particles relative to the carrier, and the mixing conditions and charge quantity measuring conditions are also made equal to those of the toner particles. As a result, since the charge quantities of the toner particles and the same polarity particles have the same sign (positive or negative sign), it is confirmed that, when the absolute value of the charge quantity of the same polarity particles is larger than the absolute value of the charge quantity of the toner particles, the corresponding same polarity particles are charged to the same polarity as the charge polarity of the toner particles relative to the carrier, upon frictional contact with the toner particles.

In the case when, for example, toner particles that are charged to negative polarity upon frictional contact with the carrier are used, those particles that are charged to negative polarity upon frictional contact with the carrier are used as the same polarity particles. Those same polarity particles may be formed by using the same material as that of the reverse polarity particles formed in the case when particles that are charged to a negative polarity upon frictional contact with the carrier are used as the reverse polarity particles. Examples of preferable combinations between the material forming the reverse polarity particles (positively chargeable) and the material forming the same polarity particles (negatively chargeable) are shown below:

Reverse Polarity Particles (Positively Chargeable)—Same Polarity Particles (Negatively Chargeable)
Strontium titanate—Silica
Barium titanate—Titanium oxide
Calcium zirconate—Aluminum oxide
Magnesium zirconate—Polyfluoroacrylic beads Examples of silica particles to be used as such same polarity particles include: commercially available products made by Nippon Aerosil Co., Ltd., such as R-805, R-976, R-974, R-972, R-812, R-809 and #50, products made by Hoechst Inc., such as HVK-2150 and H-200, commercially available products made by Cabot Co., such as TS-720, TS-530, TS-610, H-5 and MS-5, and products made by Nippon Shokubai Co., Ltd., such as Sea Hoster® KE-P10, KE-P30 and the like. Examples of those titanium oxide particles include: commercially available products made by Nippon Aerosil Co., Ltd., such as T-805 and T-604, commercially available products made by Tayca Co., such as MT-100S, MT-100B, MT-500BS, MT-600, MT-600SS and JA-1, commercially available products made by Fuji Titanium Industry Co., Ltd., such as TA-300SI, TA-500, TAF-130, TAF-510 and TAF-510T, and commercially available products made by Idemitsu Kosan Co., Ltd., such as IT-S, IT-OA, IT-OB and IT-OC. Examples of those aluminum oxide particles include: commercially available products made by Nippon Aerosil Co., Ltd., such as RFY-C and C-604 and commercially available products made by Ishihara Sangyo Kaisha Ltd., such as TTO-55.

In the case when, for example, toner particles that are charged to positive polarity upon frictional contact with the carrier are used, those particles that are charged to positive polarity upon frictional contact with the carrier are used as the same polarity particles. Those same polarity particles may be formed by using the same material as that of the reverse polarity particles formed in the case when particles that are charged to positive polarity upon frictional contact with the carrier are used as the reverse polarity particles. Examples of preferable combinations between the material forming the reverse polarity particles (negatively chargeable) and the material forming the same polarity particles (positively chargeable) are shown below:

Reverse Polarity Particles (Negatively Chargeable)—Same Polarity Particles (Positively Chargeable)

Silica—Strontium titanate

Titanium oxide—Barium titanate

Aluminum oxide—Calcium zirconate

Polyfluoroacrylic beads—Magnesium zirconate

In the same manner as in the reverse polarity particles, in order to control the chargeability and hydrophobicity of the same polarity particles, the surface of the inorganic particles may be surface-treated by using a silane coupling agent, a titanium coupling agent, silicone oil and the like. The surface treating agent may be selected in the same manner as in the surface-treatment of the reverse polarity particles.

The number-average primary particle size of the same polarity particles is set in a range from 80 to 800 nm, preferably from 80 to 500 nm. When the particle size of the same polarity particles is too small, the same polarity particles are buried into toner particles, and the chargeability and flowability are lowered, with the result that the image density is lowered upon carrying out endurance printing processes. In the case when the particle size of the same polarity particles is too large, since the same polarity particles are separated from the toner particle to cause degradation of chargeability and flowability, resulting in a reduction in the image density upon carrying out endurance printing processes.

The shape factor of the same polarity particles is set to 100 to 160, and from the viewpoint of further effectively preventing the reduction in the image density, it is preferably set to 105 to 160. When the shape factor is too high, the particles are hardly dispersed on the toner surface uniformly, and the separation from the toner particle tends to occur.

The shape factor can be controlled by adjusting the particle growth reaction in the manufacturing processes.

For example, in the case of silica, the shape factor of silica can be controlled by adjusting hydrolysis reaction, mass ratio of water, reaction temperature and stirring temperature during the manufacturing process by the use of a sol-gel method. More specifically, the shape factor can be increased by lowering the reaction rate. In contrast, the shape factor can be decreased by raising the reaction rate.

In the case of titanium oxide, upon obtaining spherical titanium by firing hydrous titanium dioxide particles obtained by subjecting titanyl sulfate to a hydrolysis reaction at a specific temperature under a specific pressure, the shape factor can be adjusted by adjusting the temperature at the time of the hydrolysis reaction and the firing temperature. In particular, when the firing temperature becomes too high, the shape factor becomes greater due to interparticle sintering or the like.

In the case of aluminum oxide, for example, upon obtaining alumina by using a Bayer method, the shape factor can be controlled by adjusting the core generation and the crystal growth process at the time of crystallization.

From the viewpoint of improving the long-term stability of toner charge through the improvement of the flowability of toner on the developing roller, the content of the same polarity particles is preferably set to 0.1 to 5 parts by weight, preferably to 0.5 to 4 parts by weight, more preferably to 0.5 to 3 parts by weight, relative to 100 parts by weight of toner particles. The two or more kinds of the same polarity particles may be used in combination, and in this case, the total amount thereof can be set in the above-mentioned range.

Not only the above-mentioned reverse polarity particles and same polarity particles, but also inorganic particles having a comparatively small particle size are externally added to the toner particles more preferably. Examples of such inorganic fine particles include inorganic fine particles of silica, titanium oxide, aluminum oxide and the like. In particular, those inorganic fine particles are preferably subjected to a hydrophobicity-applying treatment by using a silane coupling agent, a titanium coupling agent or silicone oil, and then externally added thereto. The inorganic fine particles are preferably added at a rate of 0.1 to 5 parts by weight, relative to 100 parts by weight of the toner. The number-average primary particle size of the inorganic fine particles is preferably set in a range from 10 nm or more to less than 95 nm, more preferably from 10 to 50 nm.

The toner to be used in the present invention can be obtained by mixing at least an external additive, such as reverse polarity particles and same polarity particles, with toner particles. From the viewpoints of transferring the reverse polarity particles to the carrier and of allowing the same polarity particles to adhere to the toner particles to be secured thereto, although not particularly limited, the order of adding processes of the reverse polarity particles and same polarity particles is preferably set in such a manner that, after one portion of the inorganic fine particles has been added to and mixed with the toner particles, the same polarity particles are added to and mixed with the resulting particles, and the rest of the inorganic fine particles are then added to and mixed with them, and lastly, the reverse polarity particles are added to and mixed therewith. Various known mixing devices, for example, such as a tabular mixer, a Henschel mixer, a Nauta mixer and a V-type mixer, may be used as the mixing device. In the mixing process immediately after adding the same polarity particles, the temperature inside the mixing device is preferably raised to the neighborhood of the glass transition temperature of the toner particles so as to accelerate the same polarity particles to properly adhere to the toner particles. The same polarity particles may be mechanically secured thereto by using a hybridization system or the like.

Developer for Hybrid Development

A developer for hybrid development (hereinafter, referred to simply as "developer") relating to the present invention includes the aforementioned toner and carrier.

Those known carriers, generally used conventionally, may be used as the carrier. For example, the binder-type carrier or the coat-type carrier may be used. Although not particularly limited, the particle size of the carrier is preferably set in a range of about 15 to 100 μm.

The binder-type carrier, which is formed by dispersing magnetic fine particles in a binder resin, may have a structure in which positively chargeable or negatively chargeable fine particles are applied onto its surface or a coating layer is formed thereon. The charging characteristics, such as polarity, of the binder-type carrier, can be controlled by the kinds of the binder resin for the carrier, the chargeable fine particles and the surface coating layer as well as the combination of these with the toner particles.

Examples of the binder resin used for the binder-type carrier include thermoplastic resins, such as vinyl-based resins, typically exemplified by polystyrene-based resins, polyester-based resins, nylon-based resins and polyolefin-based resins, and hardening resins, such as phenol resins and silicone resins.

Examples of the magnetic fine particles used for the binder-type carrier include: magnetite, spinel ferrites such as gamma iron oxide, spinel ferrites containing one kind or two or more kinds of metals (Mn, Ni, Mg, Cu and the like) other than iron, magnetoplumbite-type ferrites such as barium ferrite, and particles of iron or an alloy thereof, each having an oxide layer formed on the surface thereof. The shape of the carrier may be formed into any of a particle shape, a spherical shape and a needle shape. In particular, when high magnetization is required, iron-based ferromagnetic fine particles may be preferably used. From the viewpoint of chemical stability, ferromagnetic fine particles of spinel ferrite containing magnetite, gamma iron oxide or the like and magnetoplumbite-type ferrite, such as barium ferrite, are preferably used. By properly selecting the kind and content of the ferromagnetic fine particles, a magnetic resin carrier having a desired magnetization can be obtained. The magnetic fine particles are preferably added to the magnetic resin carrier at a rate in a range from 50 to 90% by weight.

Examples of a surface coating material for the binder-type carrier include silicone resin, acrylic resin, epoxy resin and fluorine-based resin. By coating the carrier surface with any one of these resins to be hardened so that a coat layer is formed thereon, the charge-applying capability of the carrier can be improved.

The anchoring of the chargeable fine particles or conductive fine particles onto the surface of the binder-type carrier is carried out through, for example, processes in which the magnetic resin carrier and the fine particles are uniformly mixed so that the fine particles are allowed to adhere to the surface of the magnetic resin carrier, and the fine particles are then injected to the magnetic resin carrier to be secured therein, by applying a mechanical/thermal impact thereto. In this case, the fine particles are not embedded into the magnetic resin carrier completely, but secured thereto so as to partially protrude from the surface of the magnetic resin carrier. An organic or inorganic insulating material is used as the chargeable fine particles. More specifically, examples of the organic insulating material include organic insulating fine particles made from polystyrene, styrene-based copolymer, acrylic resin, various acrylic copolymers, nylon, polyethylene, polypropylene, fluorine resin, or crosslinked products thereof. The charge-applying capability and the charging polarity can be adjusted by the material, polymerizing catalyst, surface treatment and the like of the chargeable fine particles. Examples of the inorganic insulating material include inorganic fine particles that are charged to negative polarity, such as silica and titanium dioxide, and inorganic fine particles that are charged to positive polarity such as strontium titanate and alumina.

The coat-type carrier is a carrier formed by coating a carrier core particle made from a magnetic material with a resin, and in the same manner as in the binder-type carrier, chargeable fine particles that are charged to positive polarity or negative polarity can be anchored on the carrier surface. The charging characteristics, such as polarity, of the coat-type carrier can be adjusted by selecting the kind of the surface coating layer and the chargeable fine particles. The same resin as the binder resin of the binder-type carrier can be used as the coating resin.

The mixed ratio of the toner and the carrier is desirably adjusted so that a desired quantity of toner charge is obtained, and the toner ratio is preferably set to 3 to 50% by weight, preferably to 6 to 30% by weight, relative to the total amount of the toner and the carrier.

The charged polarity of each of the particles in the mixture of the toner particles, carrier, reverse polarity particles and same polarity particles can be easily confirmed by a direction of an electric field used for separating each of the toner particles, carrier, reverse polarity particles and same polarity particles from a developer that has been obtained by mixing and stirring the mixture.

Image-Forming Apparatus

The developer of the present invention is used for a hybrid developing device and an image-forming apparatus provided with such a developing device. The hybrid developing system refers to a system in which a two-component developing agent, held on the outer circumferential face of a first transporting member (transporting roller), is transported to an area opposing to a second transporting member (developing roller) so that the toner is selectively supplied to the outer circumferential face of the second transporting member to form a toner thin layer on the outer circumferential face of the second transporting member, and an electrostatic latent image on the electrostatic latent image-supporting member is developed by using the toner thin film. In the present invention the aforementioned developer is used as the two-component developing agent.

Referring to the attached drawings, preferred embodiments of the present invention are explained hereinafter. In the following description, terms indicating specific directions (for example, "up", "down", "left" and "right" and other terms including these, as well as "clockwise" and "counter-clockwise") are used; however, these terms are used only for easiness of understanding of the present invention by reference to the drawings, and the present invention is not intended to be interpreted in a limited manner by the meanings of these terms. In the image-forming apparatus and the developing device described below, the same or similar components are indicated by the same reference numerals.

FIG. 1 shows components relating to image-forming processes of an electrophotographic image-forming apparatus in accordance with the present invention. The image-forming apparatus may be any one of a copying machine, a printer, a facsimile and a composite machine provided with these functions in a composite manner. An image-forming apparatus 11 is provided with a photosensitive member 12 serving as an electrostatic latent image-supporting member. In this embodiment, the photosensitive member 12 is made of a cylindrical member; however, the present invention is not limited to this mode, and instead of this, a photosensitive member of an endless belt type may also be used. The photosensitive member 12 is coupled to a motor, not shown, to be driven thereby, and allowed to rotate in a direction indicated by arrow 14 when driven by the motor. On the periphery of the photosensitive member 12, a charging station 16, an exposing station 18, a developing station 20, a transferring station 22 and a cleaning station 24 are disposed along the rotation direction of the photosensitive member 12. In the present embodiment, description will be given by exemplifying a structure in which an inversion developing method has been adopted; however, a so-called regular developing method may be adopted.

The charging station 16 is provided with a charging device 26 that charges a photosensitive layer forming the outer circumferential face of the photosensitive member 12 to a predetermined electric potential. In the present embodiment, the charging device 26 is shown as a roller having a cylindrical shape; however, instead of this, a charging device of another mode (for example, a brush-type charging device of a rotation type or a fixed type, or a wire discharging-type charging device) may be used. The exposing station 18 is provided with a passage 32 that allows imaging light 30, emitted from an exposing device 28 placed near the photosensitive member 12 or at a position apart from the photosensitive member 12, to proceed toward the outer circumferential face of the charged photosensitive member 12. On the outer circumferential face of the photosensitive member 12 that has passed through the exposing station 18, an electrostatic latent image, made of portions where the electric potential has been decayed by the imaging light projected thereto and portions where the charged electric potential has been virtually maintained, is formed. In the present embodiment, the portions having the decayed electric potential correspond to an electrostatic latent image portion, and the portions that virtually maintain the charged electric potential correspond to an electrostatic image non-image portion. The developing station 20 has a developing device 34 that visualizes the electrostatic latent image by using a powder developer. The developing device 34 will be described later in detail. The transferring station 22 is provided with a transferring device 36 that transfers the visible image formed on the outer circumferential face of the photosensitive member 12 onto a sheet 38 such as paper and a film. In the present embodiment, the transferring member 36 is shown as a roller having a cylindrical shape; however, a transferring device of another mode (for example, wire charging-type transferring device) may be used. The cleaning station 24 is provided with a cleaning device 40 that collects an untransferred toner remaining on the outer circumferential face of the photosensitive member 12, without having been transferred onto the sheet 38 in the transferring station 22, from the outer circumferential face of the photosensitive member 12. In the present embodiment, the cleaning device 40 is shown as a plate-shaped blade; however, instead of this, a cleaning device of another mode (for example, a rotation-type or fixed type brush-cleaning device) may be used.

Upon forming an image by using the image-forming device 11 with this structure, the photosensitive member 12 rotates clockwise by the driving operation of the motor (not shown). At this time, the outer circumferential portion of the photosensitive member that has passed through the charging station 16 is charged by the charging device 26 to a predetermined electric potential. The charged outer circumferential portion of the photosensitive member is exposed by the imaging light 30 in the exposing station 18 so that an electrostatic latent image is formed. The electrostatic latent image is transported to the developing station 20 by the rotation of the photosensitive member 12, and visualized therein by the developing device 34 as a developer image. The developer image thus visualized is transported to the transferring station 22 by the rotation of the photosensitive member 12, and transferred onto a sheet 38 by the transferring device 36 therein. The sheet 38 on which the developer image has been transferred, is transported to a fixing station, not shown, where the developer image is fixed on to the sheet 38. The outer circumferential portion of the photosensitive member that has passed through the transferring station 22 is then transported to the cleaning station 24 where the developer that remains on the outer circumferential face of the photosensitive member 12 without being transferred onto the sheet 38 is collected.

Developing Device

The developing device 34 is provided with a developing vessel (housing) 42 that houses a developer 10 of the present invention and various members that will be described below. For easiness of understanding of the present invention, one portion of the developing vessel 42 is omitted so as to simplify the drawings. The developing vessel 42 is provided with a series of openings (44, 52) that are opened toward the photosensitive member 12, and a developing roller 48 serving as a toner transporting member (second transporting member) is placed in a space 46 formed near the opening 44. This developing roller 48, which is a cylindrical member (second rotation cylindrical member), is rotatably placed in parallel with the photosensitive member 12, with a predetermined developing gap 50 interposed relative to the outer circumferential face of the photosensitive member 12.

Another space 52 serving as an opening portion is formed behind the developing roller 48. In this space 52, a transporting roller 54 serving as a developer transporting member (first transporting member) is disposed in parallel with the developing roller 48, with a predetermined supply/recovery gap 56 being interposed between it and the outer circumferential face of the developing roller 48. The transporting roller 54 is provided with a magnet member 58 secured thereto so as not to rotate, and a cylindrical sleeve 60 (first rotation cylindrical member) supported so as to rotate on the periphery of the magnet member 58. Above the sleeve 60, a regulating blade 62, which is secured to the developer vessel 42, and extends in parallel with the center axis of the sleeve 60, is placed face to face therewith, with a predetermined regulating gap 64 interposed therebetween.

The magnet member 58 has a plurality of magnetic poles that are aligned face to face with the inner face of the transporting roller 54, and extended in the center axis direction of the transporting roller 54. In the present embodiment, the magnetic poles include a magnetic pole S1 that faces the upper inner circumferential portion of the transporting roller 54 located near the regulating blade 62, a magnetic pole N1 that faces the inner circumferential face on the left side of the transporting roller 54 located near the supply/recover gap 56, a magnetic pole S2 that faces the lower inner circumferential face of the transporting roller 54, and two adjacent magnetic poles N2 and N3 having the same polarity, which face the inner circumferential face on the right side of the transporting roller 54.

A developer stirring chamber 66 is formed behind the transporting roller 54. The stirring chamber 66 is provided with a front chamber 68 formed near the transporting roller 54 and a rear chamber 70 apart from the transporting roller 54. A front screw 72, which serves as a front stirring transport member that transports the developer from the surface of the drawing toward the rear face thereof, while stirring the developer, is placed in the front chamber 68 so as to rotate therein, and a rear screw 74, which serves as a rear stirring transport member that transports the developer from the rear face toward the surface of the drawing, while stirring the developer, is placed in the rear chamber 70 so as to rotate therein. As shown in the Figure, the front chamber 68 and the rear chamber 70 may be separated by a partition wall 76 placed between the two chambers. In this case, a partition wall portion located near the two ends of the front chamber 68 and the rear chamber 70 is removed to form a communication passage so that the developer that has reached the end portion on the downstream side of the front chamber 68 is sent to the rear chamber 70 through the communication passage, while the developer that has reached the end portion on the downstream side of the rear chamber 70 is sent to the front chamber 68 through the communication passage.

The following description will discuss operations of the developing device 34 structured as described above. Upon forming an image, the developing roller 48 and the sleeve 60, driven by motors not shown, are allowed to rotate respectively in directions of arrows 78 and 80. The front screw 72 rotates in a direction of arrow 82, while the rear screw 74 rotates in a direction of arrow 84. Consequently, developer 10, housed in the developer stirring chamber 66, is stirred, while being transported and circulated between the front chamber 68 and the rear chamber 70. As a result, the toner (toner particles) and carrier contained in the developer are made friction-contact with each other to be charged to respectively reversed polarities.

The developer 10, thus charged, is supplied to the transporting roller 54, while being transported through the front chamber 68 by the front screw 72. The developer 10, supplied onto the transporting roller 54 from the screw 72, is held onto the outer circumferential face of the sleeve 60 near the magnetic pole N3 by the magnetic force of the magnetic pole N3. The developer 10, held on the sleeve 60, forms a magnetic brush along lines of magnetic forces formed by the magnet member 58, and is transported counterclockwise due to the rotation of the sleeve 60. The developer 10, held by the magnetic pole S1 on an opposing area (regulating area 86) to the regulating blade 62, is regulated by the regulating blade 62 so that the amount thereof to be allowed to pass through the regulating gap 64 is regulated to a predetermined amount. The developer 10 that has passed through the regulating gap 64 is transported to an area (supply/recover area) 88 opposing to the magnetic pole N1, where the developing roller 48 and the transporting roller 54 are made face to face with each other. Mainly at an area (supply area) 90 on the upstream side of the supply/recovery area 88 relative to the rotation direction of the sleeve 60, the toner (toner particles) adhering to the carrier is electrically supplied to the developing roller 48 due to the presence of an electric field formed between the developing roller 48 and the sleeve 60. The same polarity particles behave together with the toner particles so that the flowability of the toner particles is improved on the developing roller. Mainly at an area (recovery area) 92 on the downstream side of the supply/recovery area 88 relative to the rotation direction of the sleeve 60, toner (toner particles) on the developing roller 48 that has not been consumed by the developing and has been returned to the supply/recovery area 88 is scraped by the magnetic brush formed along the lines of magnetic forces of the magnetic pole N1, and recovered by the sleeve 60. The carrier is held on the outer circumferential face of the sleeve 60 by a magnetic force of the magnet member 58, and is not transferred to the developing roller 48 from the sleeve 60. In the present invention, the reverse polarity particles behave together with the carrier so that the toner chargeability of the carrier is prevented from being lowered.

The developer 10, which has passed through the supply/recovery area 88, is held by the magnetic force of the magnet member 58 so that, when having reached the opposing area (releasing area 94) between the magnetic poles N2 and N3 after having passed through the opposing portion to the magnetic pole S2 along with the rotation of the sleeve 60, the developer 10 is released from the outer circumferential face of the sleeve 60 toward the front chamber 68 by a repulsive magnetic field formed by the magnetic poles N2 and N3, and mixed with the developer 10 that is being transported through the front chamber 68.

The toner (toner particles), held by the developing roller 48 at the supply area 90, is transported counterclockwise along with the rotation of the developing roller 48 so that, at an area (developing area) 96 where the photosensitive member 12 and the developing roller 48 are made face to face with each other, the toner is allowed to adhere to an electrostatic latent image portion formed on the outer circumferential face of the photosensitive member 12. In an image-forming apparatus of the present embodiment, a predetermined electric potential $V_H$ of the negative polarity is applied to the outer circumferential face of the photosensitive member 12 by a charging device 26, and the electrostatic latent image portion to which imaging light 30 has been projected by the exposing device 28 is decayed to a predetermined electric potential $V_L$ so that the electrostatic latent image non-image portion to which no image light 30 has been projected by the exposing device 28 is allowed to maintain virtually the charged electric potential $V_H$. Therefore, in the developing area 96, the toner charged to the negative polarity is allowed to adhere to the electrostatic latent image portion by a function of an electric field formed between the photosensitive member 12 and the developing roller 48 so that this electrostatic latent image is visualized as a developer image. The amount of the toner held as a thin film on the surface of the developing roller 48 so as to be transported to the developing area is preferably set in a range from 3 to 10 g/m$^2$.

When the toner (toner particles) has been consumed from the developer 10 in this manner, it is preferable to supply toner at an amount corresponding to the consumed amount to the developer 10. For this reason, the developing device 34 is provided with a means used for measuring a mixed ratio between the toner and the carrier housed in the developing vessel 42. A toner supplying unit 98 is placed above the rear chamber 70. The toner supplying unit 98 has a container 100 used for housing the toner. An opening portion 102 is formed on the bottom portion of the container 100, and a supplying roller 104 is placed in this opening portion 102. The supplying roller 104 is coupled to a motor, not shown, so as to be driven, and the motor is driven based upon an output of the means for measuring the mixed ratio of the toner and carrier so that the toner is allowed to drop and supplied to the rear chamber 70. In the present invention, since the developer, in particular, the reverse polarity particles, is improved in its flowability by the same polarity particles and allowed to behave together with the carrier, it is possible to suppress the consumption of the reverse polarity particles.

Electric-Field Forming Means

In order to efficiently transfer toner from the sleeve 60 to the developing roller 48 in the supply area 90, the developing roller 48 and the sleeve 60 are electrically connected to an electric-field forming device 110. FIGS. 2A to 6 show specific examples of the power supply.

Figure 2A:
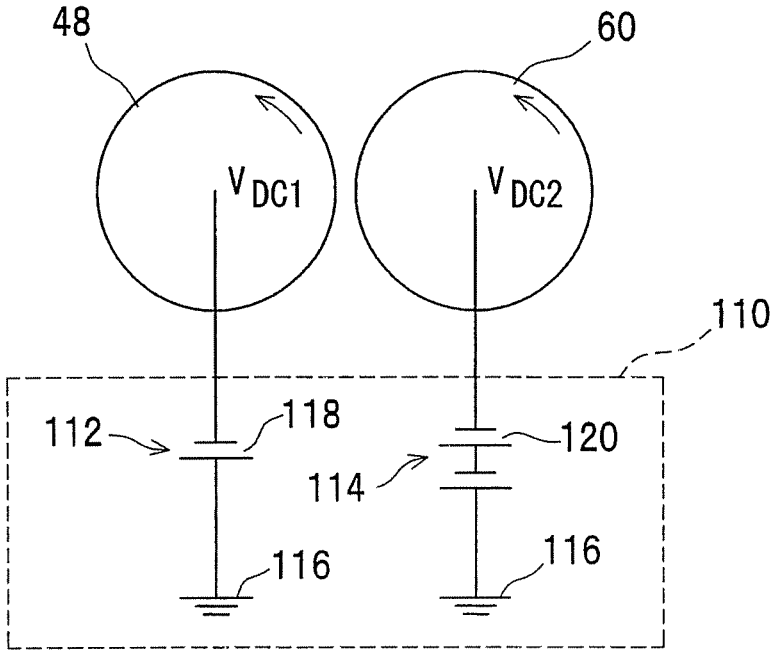
FIG. 2A is a diagram that shows one embodiment of an electric-field forming device.
Figure 2B:
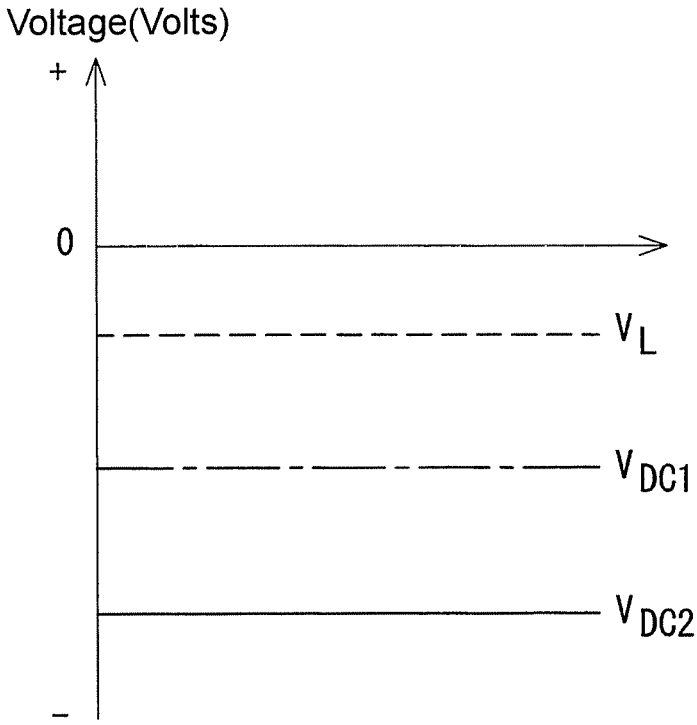
FIG. 2B is a diagram that shows the relationship between voltages to be supplied from the electric-field forming device shown in FIG. 2A to a sleeve and a developing sleeve.

An electric-field forming device 110 of embodiment 1, shown in FIG. 2A, is provided with a first power supply 112 connected to the developing roller 48 and a second power supply 114 connected to the sleeve 60. The first power supply 112 is provided with a dc power supply 118 connected between the developing roller 48 and the ground 116 so that a first dc voltage $V_{DC1}$ (for example, −200 volts) having the same polarity as the charged polarity of the toner is applied to the developing roller 48. The second power supply 114 is provided with a dc power supply 120 connected between the sleeve 60 and the ground 116 so that a second dc voltage $V_{DC2}$ (for example, −400 volts) having the same polarity as the charged polarity of the toner and a higher voltage than the first dc voltage is applied to the sleeve 60. As a result, in the supply area 90, the toner charged into the negative polarity is electrically attracted from the sleeve 60 onto the developing roller 48 by the function of a dc electric field formed between the developing roller 48 and the sleeve 60. At this time, the carrier, charged into the positive polarity, is not attracted from the sleeve 60 onto the developing roller 48. In the developing area 96, the negative polarity toner, held on the developing roller 48, is allowed to adhere to the electrostatic latent image portion as shown in FIG. 2B, based upon the electric potential difference between the developing roller 48 ($V_{DC1}$: −200 volts) and the electrostatic latent image portion ($V_L$: −80 volts). In this case, the negative polarity toner, which is subjected to an electric potential difference between the developing roller 48 ($V_{DC1}$: −200 volts) and the electrostatic latent image non-image portion ($V_H$: −600 volts), is not allowed to adhere to the electrostatic latent image non-image portion.

Figure 3A:
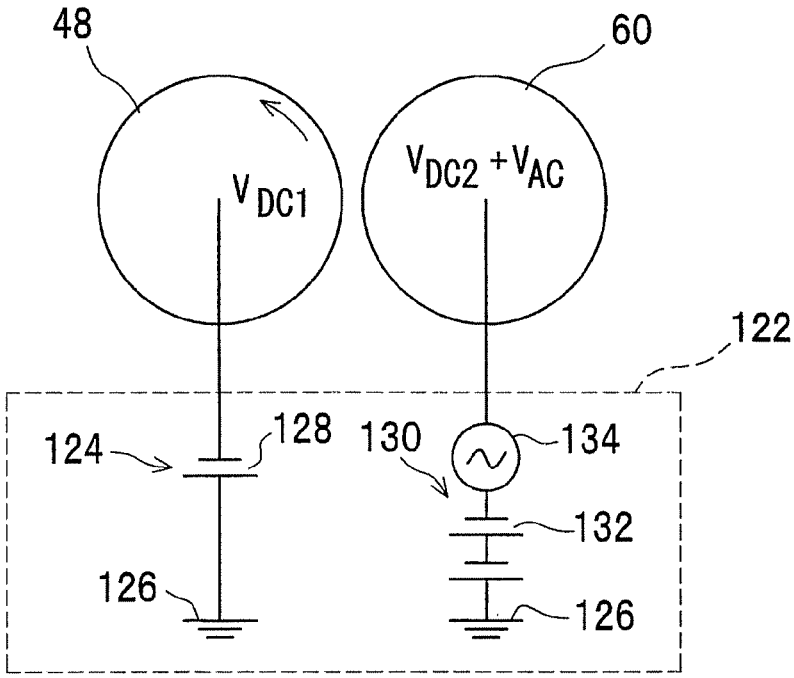
FIG. 3A is a diagram that shows another embodiment of the electric-field forming device.
Figure 3B:
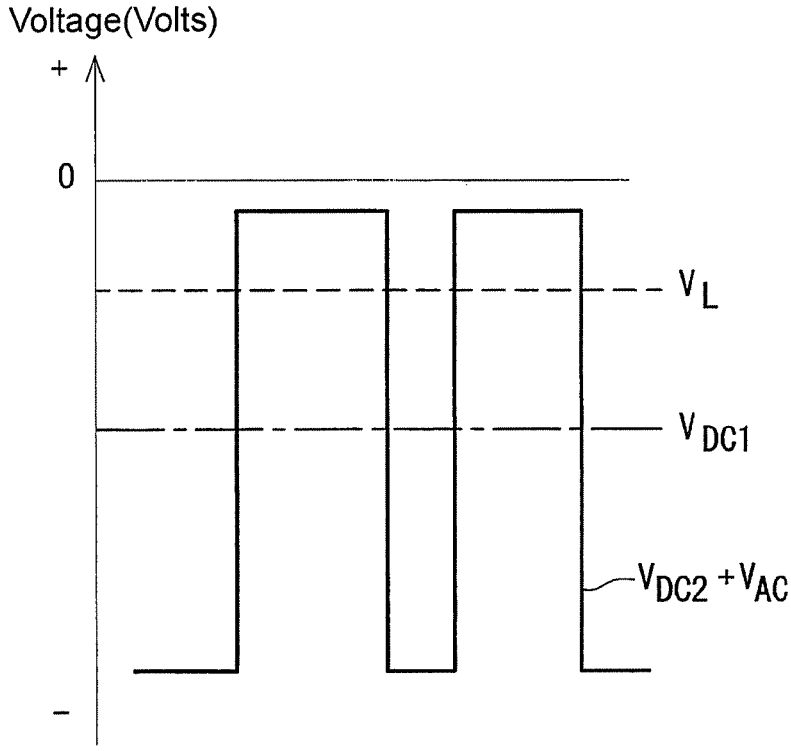
FIG. 3B is a diagram that shows the relationship between voltages to be supplied from the electric-field forming device shown in FIG. 3A to a sleeve and a developing sleeve.

In an electric-field forming device 122 according to embodiment 2, shown in FIG. 3A, a first power supply 124 is provided with a dc power supply 128 connected between the developing roller 48 and the ground 126 in the same manner as in the power supply of embodiment 1 so that a first dc voltage $V_{DC1}$ (for example, −200 volts) having the same polarity as the charged polarity of the toner is applied to the developing roller 48. A second power supply 130 is provided with a dc power supply 132 and an ac power supply 134 between the sleeve 60 and the ground 126. The dc power supply 132 applies a second dc voltage $V_{DC2}$ (for example, −400 volts) having the same polarity as the charged polarity of the toner and a higher voltage than the first dc voltage to the sleeve 60. As shown in FIG. 3B, the ac power supply 134 applies an ac voltage $V_{AC}$ having a peak-to-peak voltage $V_{P-P}$ of, for example, 300 volts between the sleeve 60 and the ground 126. As a result, in the supply area 90, the toner, charged into the negative polarity, is electrically attracted from the sleeve 60 onto the developing roller 48, by the function of a pulsating current electric field formed between the developing roller 48 and the sleeve 60. At this time, the carrier, charged into the positive polarity, is held on the sleeve 60 by a magnetic force of fixed magnets inside the sleeve 60, and is not supplied to the developing roller 48. In the developing area 96, the negative polarity toner, held on the developing roller 48, is allowed to adhere to the electrostatic latent image portion based upon the electric potential difference between the developing roller 48 ($V_{DC1}$: −200 volts) and the electrostatic latent image portion ($V_L$: −80 volts).

Figure 4A:
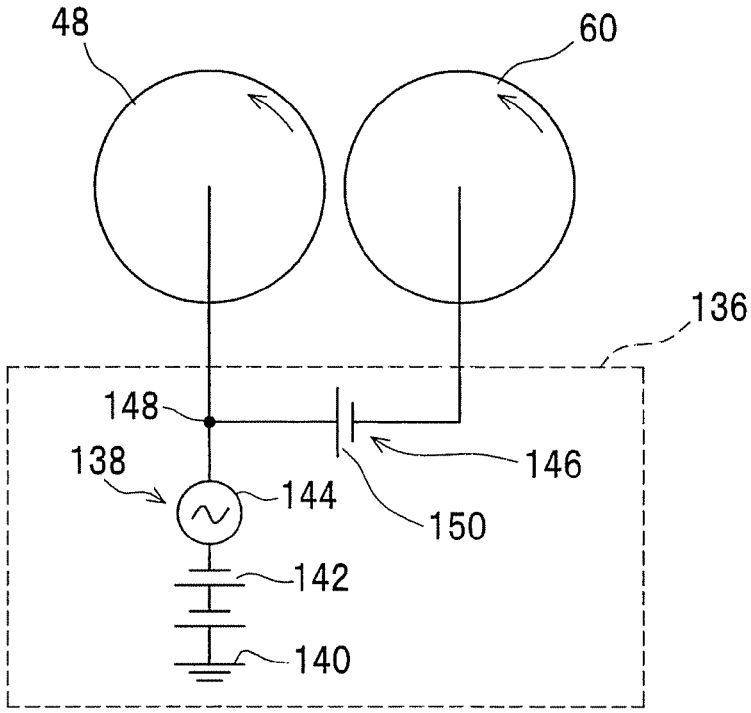
FIG. 4A is a diagram that shows another embodiment of the electric-field forming device.
Figure 4B:
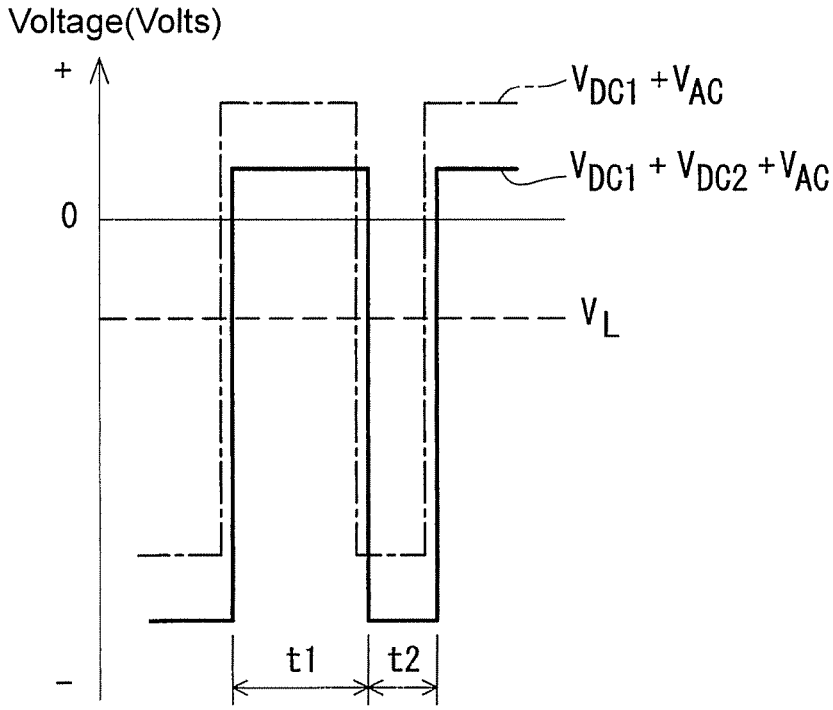
FIG. 4B is a diagram that shows the relationship between voltages to be supplied from the electric-field forming device shown in FIG. 4A to a sleeve and a developing sleeve.

In an electric-field forming device 136 shown in FIG. 4A, a first power supply 138 has a dc power supply 142 and an ac power supply 144 between the developing roller 48 and the ground 140. The dc power supply 142 applies a first dc voltage $V_{DC1}$ (for example, −200 volts) having the same polarity as the charged polarity of the toner to the sleeve 60 and the developing roller 48. The ac power supply 144 applies an ac voltage $V_{AC}$ having an amplitude (a peak-to-peak voltage) $V_{P-P}$ of, for example, 1,600 volts between the sleeve 60 as well as the developing roller 48 and the ground 146. A second power supply 146 has a do power supply 150 connected between a terminal 148, located between the developing roller 48 and the ac power supply 144, and the sleeve 60. The dc power supply 150 is allowed to output a predetermined dc voltage $V_{DC2}$, with its positive pole connected to the terminal 148 and its negative pole connected to the sleeve 60, so that the sleeve 60 is biased to the negative polarity relative to the developing roller 48 (see FIG. 4B). Therefore, in the supply area 90, the toner, charged into the negative polarity, is electrically attracted from the sleeve 60 onto the developing roller 48, by the function of a pulsating current electric field formed between the developing roller 48 and the sleeve 60. In the developing area 96, the negative polarity toner, held on the developing roller 48, is allowed to adhere to the electrostatic latent image portion based upon the electric potential difference between the developing roller 48 ($V_{DC1}$: −200 volts) and the electrostatic latent image portion ($V_L$: −80 volts).

Figure 5:
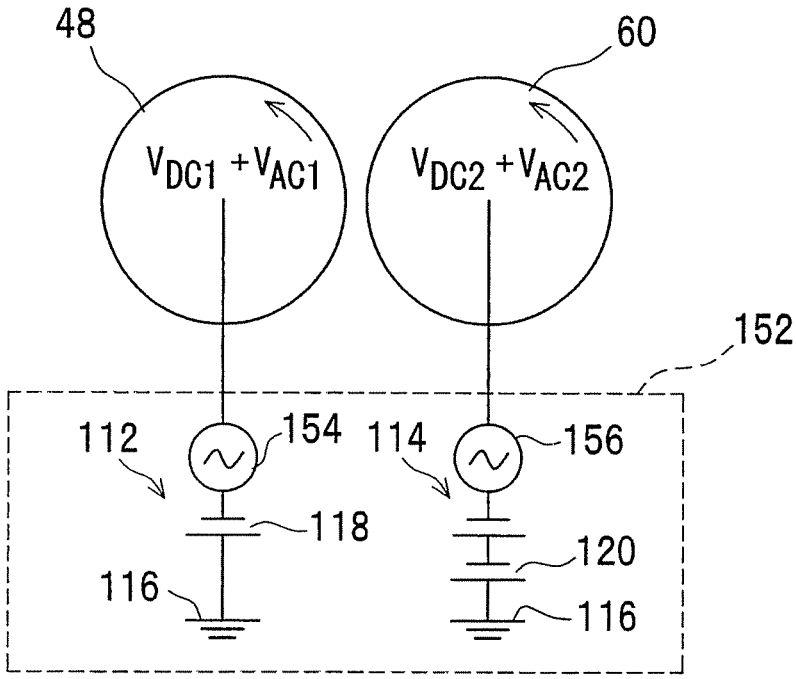
FIG. 5 is a diagram that shows another embodiment of the electric-field forming device.
Figure 6:
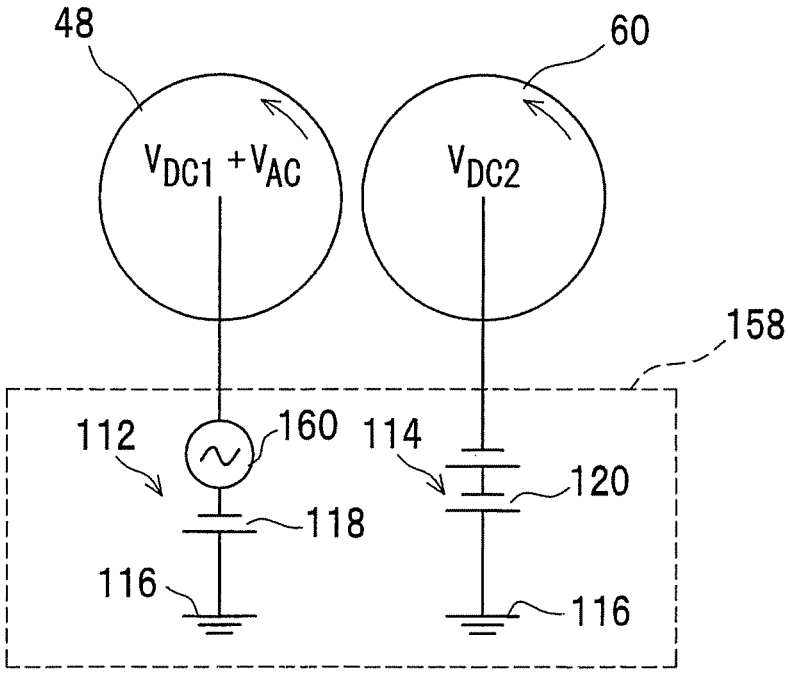
FIG. 6 is a diagram that shows another embodiment of the electric-field forming device.

An electric-field forming device 152, shown in FIG. 5, has a structure in which ac power supplies 154 and 156 are respectively added to the first power supply 112 and the second power supply 114 of the electric-field forming device 110 of embodiment 1 shown in FIG. 2A. The output voltages of the ac power supplies 154 and 156 are $V_{AC1}$ and $V_{AC2}$. The voltages $V_{AC1}$ and $V_{AC2}$ may be the same or different from each other. An electric-field forming device 158, shown in FIG. 6, has a structure in which an ac power supply 160 is added to the first power supply 112 of the embodiment shown in FIG. 2A. The output voltage of the ac power supply 160 is $V_{AC}$. In the same manner as in the electric-field forming devices 110, 122 and 136, the electric-field forming devices 152 and 158 of these modes supply the toner charged into the negative polarity from the sleeve 60 to the developing roller 48 by the function of a pulsating current electric field formed between the developing roller 48 and the sleeve 60 in the supply area 90, and also supply the toner charged into the negative polarity from the developing roller 48 to the electrostatic latent image portion based upon the electric potential difference between the developing roller 48 and the electrostatic latent image portion ($V_L$: −80 volts), in the developing area 96.

In the above-mentioned image-forming apparatus and the developing device, by frictional contact between toner particles and a carrier, the toner particles are charged into negative polarity, while the carrier is charged into positive polarity. Reverse polarity particles are charged into positive polarity when made in contact with the carrier, while same polarity particles are charged into negative polarity when made in contact with the carrier. The charging characteristics of the toner particles, carrier, reverse polarity particles and same polarity particles to be used in the present invention are not limited to this combination. More specifically, another combination may used in which, by frictional contact between toner particles and a carrier, the toner particles are charged into positive polarity, while the carrier is charged into negative polarity, and reverse polarity particles are charged into negative polarity when made in contact with the carrier, while same polarity particles are charged into positive polarity when made in contact with the carrier.

EXAMPLES

The present invention is explained by means of examples hereinafter; however, it is clear that the present invention is not intended to be limited by the following examples. In the following description, the term "parts" refers to "parts by weight".

Production of Carrier

A coat-type carrier formed by coating carrier core particles made of a magnetic material with a silicon resin, having an average particle size of about 33 μm, that is, a carrier for a biz hub C350 made by Konica Minolta Business Technologies, Inc., was used.

Production of Toner Particles

Toner particles were produced by using an emulsion polymerization association method. The binder resin of the toner particles was a styrene-acrylic copolymer. The volume-average particle size thereof was 6.5 μm, the average degree of roundness was 0.95, and the glass transition point was 50° C. After the toner particles were mixed with the carrier, the blow-off quantity of charge of the toner particles was measured, and the measured value showed a negative value.

Spherical Silica

Among commercially available silica materials, one having predetermined values in the number-average primary particle size and the shape factor was selected and used. With respect to the materials having a shape factor of 110 or less, those materials of Sea Hoster® KE series, made by Nippon Shokubai Co., Ltd., were used. With respect to the materials having a shape factor of 110 or more, silica particles having a plurality of aggregated primary particles, obtained by surface-treating #50 (100 parts by weight) made by Nippon Aerosil Co., Ltd. with 10 parts of hexamethyldisilazane and adjusting particle size distribution by means of a wind force classifier, were used.

When, after having been mixed with the carrier, the blow-off quantity of charge was measured thereon, any of spherical silica particles showed a negative value.

Strontium Titanate

With respect to strontium titanate particles having predetermined shape factor and number-average primary particle size, those of SW series commercially available by Titanium Industry Co., Ltd. having predetermined values were selected and used.

When, after being mixed with the carrier, the blow-off quantity of charge was measured, any of strontium titanate particles showed a positive value.

Example 1

To 100 parts by weight of toner particles was added 0.1 part by weight of a first hydrophobic silica, and mixed for one minute at a speed of 40 m/s by using Henschel mixer (made by Mitsui Mining & Smelting Co., Ltd.). To this mixture was added 2 parts by weight of spherical silica having a shape factor of 105 and a number-average primary particle size of 200 nm as same polarity particles, and mixed for 5 minutes at a speed of 40 m/s by using the Henschel mixer. The temperature of the inside of the Henschel mixer was set to about 5° C. higher than Tg of the toner particles. To this mixture were added 0.2 parts by weight of the first hydrophobic silica, 0.5 parts by weight of a second hydrophobic silica and 0.5 parts by weight of hydrophobic titanium oxide, and mixed for 3 minutes at a speed of 40 m/s by using the Henschel mixer. Then, to this mixture was added 2 parts by weight of strontium titanate particles having a shape factor of 190 and a number-average primary particle size of 350 nm, and mixed for 3 minutes at a speed of 40 m/s by using the Henschel mixer so that a toner was obtained.

The first hydrophobic silica used in this case was silica having a number-average primary particle size of 16 nm (#130: made by Nippon Aerosil Co., Ltd.), which was subjected to a surface treatment by hexamethyldisilazane (HMDS) serving as a hydrophobizing agent.

The second hydrophobic silica was silica having a number-average primary particle size of 20 nm (#90: made by Nippon Aerosil Co., Ltd.), which was subjected to a surface treatment by HMDS.

The hydrophobic titanium oxide was obtained by subjecting anatase-type titanium oxide having a number-average primary particle size of 30 nm to a surface treatment by using isobutyl methoxysilane serving as a hydrophobizing agent in an aqueous wet system.

Examples 2 to 11/Comparative Examples 1 to 7

The same method as that of example 1 was carried out to produce toners, except that strontium titanate having predetermined shape factor and number-average primary particle size and spherical silica having predetermined shape factor and number-average primary particle size were used at predetermined addition amounts.

Evaluation

By mixing the toner and the carrier at a weight rate of 8:92 (toner:carrier), a developer was obtained. The developer was loaded into an image-forming apparatus having a structure shown in FIG. 1. By using this image-forming apparatus, 50,000 copies of a sample with a character image portion and a solid portion having an image rate of 5% were printed. The toner was supplied each time the remaining amount became smaller.

The developing conditions were as follows: An electric-field forming device having a mode shown in FIG. 6 was used, a dc voltage $V_{DC2}$: −500 volts was applied to the transporting roller, and a dc voltage $V_{DC1}$: −450 volts and an ac voltage were applied to the developing roller. The ac voltage had a rectangular wave having a frequency: 2 kHz, an amplitude $V_{P-P}$: 1,600 volts, a minus duty ratio (toner recovery duty ratio): 40% and a plus duty ratio (toner supply duty ratio): 60%. The developing gap 50 was set to 0.3 mm, the supply/recovery gap 56 was set to 0.6 mm, and the regulating unit was set so that the amount of transporting developer on the transporting roller was 50 mg/cm$^2$. The charged potential (non-image portion) of the photosensitive member was −550 volts, and the electric potential (image portion) of an electrostatic latent image formed on the photosensitive member was −60 volts. The amount of transferring toner on the developing roller was 5 g/m$^2$.

Image Density

After endurance printing processes, the transmission density of a solid portion on each of the first sheet and the 50,000$^{th}$ sheet was measured by using a Macbeth densitometer, and evaluation was made based upon the difference between these values.

⊙: The density difference was less than 0.10;

○: The density difference was in a range from 0.10 or more to less than 0.15 (causing no problems in practical use);

Δ: The density difference was in a range from 0.15 or more to less than 0.20 (causing no problems in practical use);

x: The density difference was 0.20 or more (causing problems in practical use).

State of Adhesion of Same Polarity Particles

After endurance printing processes, toner on the developing roller was sampled, and the surface of the toner particles was observed by a scanning electron microscope (SEM). In the toners of examples 1 to 11, it was confirmed that comparatively many spherical silica particles were secured onto the surface of the toner particle. In the toners of comparative example 2 and comparative example 3, there were hardly any spherical silica particles secured onto the surface of the toner particle. It is considered that, in comparative example 2, the spherical silica particles were buried into the toner particle and that, in comparative example 3, the spherical silica particles were separated from the surface of the toner particle.

TABLE 1

| | To Toner | | | | | | |
|---|---|---|---|---|---|---|---|
| | Strontium Titanate | | | Spherical Silica | | | |
| | Particle Size (nm) | Shape Factor | Addition Amount (Parts by Weight) | Particle Size (nm) | Shape Factor | Addition Amount (Parts by Weight) | Image Density |
| Example 1 | 350 | 190 | 2 | 200 | 105 | 2 | ⊙ |
| Example 2 | 100 | 190 | 2 | 200 | 105 | 2 | ○ |

TABLE 1-continued

| | To Toner | | | | | | |
|---|---|---|---|---|---|---|---|
| | Strontium Titanate | | | Spherical Silica | | | |
| | Particle Size (nm) | Shape Factor | Addition Amount (Parts by Weight) | Particle Size (nm) | Shape Factor | Addition Amount (Parts by Weight) | Image Density |
| Example 3 | 800 | 190 | 2 | 200 | 105 | 2 | ○ |
| Example 4 | 350 | 190 | 2 | 80 | 105 | 2 | ○ |
| Example 5 | 350 | 190 | 2 | 800 | 105 | 2 | ○ |
| Example 6 | 350 | 190 | 2 | 200 | 110 | 2 | ○ |
| Example 7 | 350 | 190 | 2 | 200 | 160 | 2 | ○ |
| Example 8 | 350 | 190 | 2 | 200 | 105 | 0.5 | ○ |
| Example 9 | 350 | 190 | 2 | 200 | 105 | 3 | ○ |
| Example 10 | 350 | 190 | 2 | 200 | 105 | 0.3 | Δ |
| Example 11 | 350 | 190 | 2 | 200 | 105 | 3.5 | ○ |
| Comparative Example 1 | 90 | 190 | 2 | 200 | 105 | 2 | X |
| Comparative Example 2 | 350 | 190 | 2 | 70 | 105 | 2 | X |
| Comparative Example 3 | 350 | 190 | 2 | 200 | 170 | 2 | X |
| Comparative Example 4 | 350 | 190 | 2 | — | — | — | X |
| Comparative Example 5 | — | — | — | 200 | 105 | 2 | X |
| Comparative Example 6 | 900 | 190 | 2 | 200 | 105 | 2 | X |
| Comparative Example 7 | 350 | 190 | 2 | 850 | 105 | 2 | X |

REFERENCE SIGNS LIST

10: Developer, 11: Image-forming apparatus, 12: Photosensitive member, 16: Charging station, 18: Exposing station, 20: Developing station, 22: Transferring station, 24: Cleaning station, 26: Charging device, 28: Exposing device, 30: Imaging light, 32: passage, 34: Developing device, 36: Transferring device, 38: Sheet, 40: Cleaning device, 42: Developing vessel (Housing), 44: Opening portion, 46: Second space, 48: Developing roller, 50: Developing gap, 52: Opening portion (Second space), 54: Transporting roller, 56: Supply/recovery gap, 58: Magnet member, 60: Sleeve, 62: Regulating plate, 64: Regulating gap, 66: Developer-stirring chamber, 68: Front chamber, 70: Rear chamber, 72: Front screw, 74: Rear screw, 76: Partition wall, 86: Regulating area, 88: Supply/recovery area, 90: Supply area, 92: Recovery area, 94: Releasing area, 96: Developing area, 98: Toner supply portion, 100: Container, 102: Opening portion, 104: Supply roller, 110: Electric-field-forming device.

What is claimed is:

1. A toner for hybrid development, comprising:

toner particles containing at least a binder resin and a colorant, and being charged when made in friction-contact with a carrier;

reverse polarity particles that are charged into a polarity reversed to a charged polarity of the toner particles when made in friction-contact with the carrier, and have a number-average primary particle size in a range from 95 to 850 nm; and same polarity particles that are charged into the same polarity as the charged polarity of the toner particles when made in friction-contact with the carrier, and have a number-average primary particle size in a range from 80 to 800 nm and a shape factor in a range from 100 to 160.

2. The toner of claim 1, wherein the reverse polarity particles have a shape factor in a range from 120 to 250.

3. The toner of claim 1, wherein the reverse polarity particles are contained at a content of 0.1 to 4 parts by weight, relative to 100 parts by weight of the toner particles.

4. The toner of claim 1, wherein the same polarity particles are contained at a content of 0.1 to 5 parts by weight, relative to 100 parts by weight of the toner particles.

5. The toner of claim 1, further comprising inorganic fine particles having a number-average primary particle size in a range from 10 nm or more to less than 95 nm, externally added.

6. A developer for hybrid development, comprising the toner of claim 1 and a carrier.

7. The developer for hybrid development of claim 6, wherein the carrier is a binder-type carrier or a coat-type carrier.

8. The developer for hybrid development of claim 6, wherein the reverse polarity particles have a shape factor in a range from 120 to 250.

9. The developer for hybrid development of claim 6, wherein the reverse polarity particles are contained at a content of 0.1 to 4 parts by weight, relative to 100 parts by weight of the toner particles.

10. The developer for hybrid development of claim 6, wherein the same polarity particles are contained at a content of 0.1 to 5 parts by weight, relative to 100 parts by weight of the toner particles.

11. The toner of claim 1, wherein the number-average primary particle size of the same polarity particles is greater than 100 nm and less than or equal to 800 nm.

* * * * *